United States Patent [19]

Fontana

[11] Patent Number: 4,572,563

[45] Date of Patent: Feb. 25, 1986

[54] HANGING DEVICE TO A TRANSPORT MEANS, WITH FACILITATED HOOKING AND AUTOMATIC RELEASE

[75] Inventor: Ludovico Fontana, Bari, Italy

[73] Assignee: Tecnovar Italiana S.p.A., Bari, Italy

[21] Appl. No.: 575,539

[22] Filed: Jan. 31, 1984

[30] Foreign Application Priority Data

Feb. 4, 1983 [IT] Italy ..... 19433 A/83

[51] Int. Cl.[4] ..... B66C 1/36; H07B 1/02

[52] U.S. Cl. ..... 294/82.24; 294/75

[58] Field of Search ..... 294/83 R, 75, 74, 84, 294/65.5, 83 A, 83 AB

[56] References Cited

U.S. PATENT DOCUMENTS 3,871,698 3/1975 Fontana ..... 294/83 R 4,073,531 2/1978 Androski ..... 294/83 R

*Primary Examiner*—James B. Marbert

*Attorney, Agent, or Firm*—Young & Thompson

[57] ABSTRACT

A device for hanging a load, particularly to an aircraft or landcraft transport, of the type comprising an eyelet of connection to the transport having an enlarged base with a central hole, a pin rotatably supported in the hole and extending downward into a first hook part and, a second hook part pivoted on the first about a pin with horizontal axis positioned in the lower end of the first hook part. A releasable lock retains the second hook part in an active position to form with the first part an essentially closed hook. A bracket supports a load lifting sling, and an electrical connection transmits electric signals from the hook to the bracket. According to the invention, the electrical connection comprises at least one contact rod oscillating between a rest position, in which it is housed in a seat formed in the enlarged base, and an active position, in which it bears on a respective contact surface provided on the bracket, this oscillating movement being controlled by a lever moving under the action of the bracket being carried into the hooking position, and a pressure spring associated with the lever to control the pressure with which the contact rod bears on the contact surface.

6 Claims, 3 Drawing Figures

HANGING DEVICE TO A TRANSPORT MEANS, WITH FACILITATED HOOKING AND AUTOMATIC RELEASE

BACKGROUND OF THE INVENTION

1. Field of the Invention

The present invention relates to a hanging device with fast hooking and automatic release, particularly for lifting and conveying a container, said device being also apt to transfer to said container electric energy on two or more circuits.

A hanging device of this type can be used in particular, but not exclusively, for hooking and transporting a load with aircraft means, as particularly helicopters, or with landcraft means, when the load consists of a special container or distributor of sundry materials, wherein the distribution is operated under the control of electric pulses sent from the transport means.

2. Description of the Prior Art

A known device of this type, described for example in the Italian Pat. No. 953.239, comprises an eyelet of connection to the helicopter, having an enlarged base with a central hole, into which freely rotates a pin extending downward into a suspension hook. The hook is formed in two parts, one of which is fixedly connected to said pin, while the other rotates in respect of the first about a horizontal axis, placed in correspondence of the lowest part of the hook. Releasable locking means keep said second part of the hook raised, so as to form with the first part an essentially closed hook, which is perfectly apt to support the bracket of a load lifting sling. When desired, said locking means release said second hook part, which oscillates downward and frees said bracket.

This known device is completed by an electric circuit apt to transmit electric signals from the transport means, for instance a helicopter, towards the load, said circuit comprising:

three current feeding brushes, fixedly connected to the connection eyelet, and three slip rings, rotating with said hook support pin, in order to guarantee the feeding of current from the fixed eyelet to the rotating hook, leaving said hook totally free to rotate;

two contact blades, positioned on either side of the hook, whose contacts are apt to cooperate with conductive plates fixed on the two opposite sides of said bracket, in order to guarantee the feeding of current from the rotating hook to the bracket and then from this latter to the hanging container.

A device of this type, though working perfectly, has proved to undergo damage during use. In particular, the contact blades fixed to the hook sides are too exposed to atmospheric agents and to accidental impact, whereby, in a relatively short while, they are no longer apt to guarantee a perfect and safe electric connection, as indispensable.

SUMMARY OF THE INVENTION

The object of the present invention is to improve the known hanging device, and in particular to provide the same with a perfect electric connection, guaranteed in time and highly unlikely to undergo damage.

This result is obtained mainly due to the fact that, according to the invention, each of the contacts associated to the rotating hook comprises a contact rod oscillating between a rest position, in which it is housed in a seat formed in an enlarged eyelet base, and an active position, in which it rests on a respective contact surface provided on the bracket, the movement of the contact rods being controlled by a lever moving under the action of the bracket being carried into the hooking position, and by pressure spring means associated with said lever to control the pressure with which the contact rod bears on the contact surface.

BRIEF DESCRIPTION OF THE DRAWINGS

Further characteristics and advantages of the device according to the present invention will anyhow be more evident from the following description of a preferred embodiment thereof, illustrated in the accompanying drawings, in which.

DESCRIPTION OF THE PREFERRED EMBODIMENT

Figure 1:
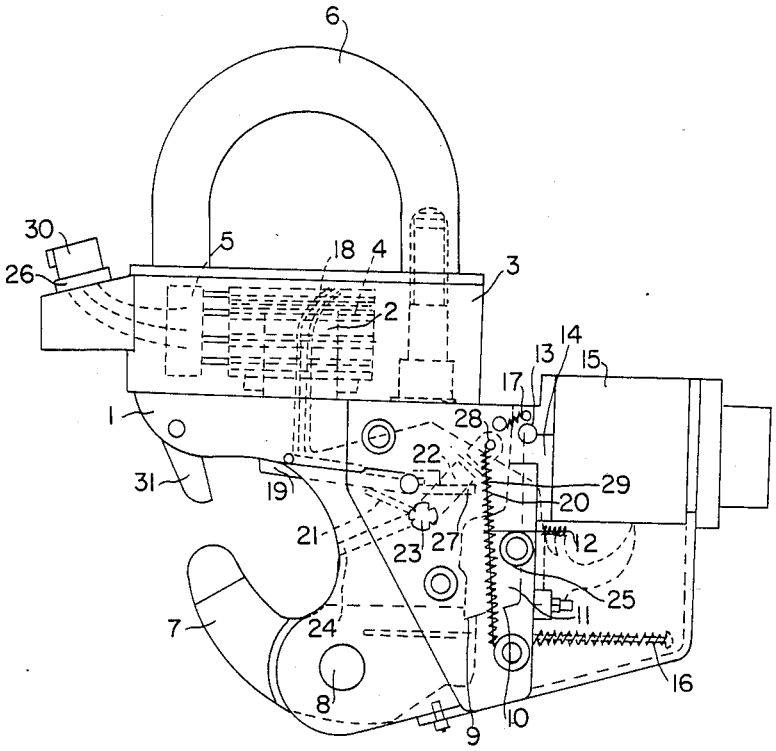
FIG. 1 is a side elevation, showing only the suspension hook.

As shown, the suspension device comprises a first hook part 1, extending upwards into a pin 2 rotating in an enlarged base 3 of an eyelet 6 of connection to the transport means, specifically a helicopter.

According to a technique known per se, the pin 2 is mounted so as to guarantee on the one hand the support of the hook part 1 on the eyelet 6, even under very heavy loads, and on the other hand the free rotation of the hook part 1 in respect of said eyelet 6.

The base 3 includes slip rings 4, each ring cooperating with a fixed contact 5 of the brush type.

As already said, the body 1 forms a first part of the suspension hook, while a second part 7 is rotatably mounted on a pin 8 with horizontal axis, positioned in correspondence with the lower end of the hook part 1.

The hook part 7 extends backwards, beyond the pin 8, into a tailpiece ending with a tooth 9, adopted to cooperate with the lower pawl-shaped end 10 of a locking lever 11.

The lever 11 is rotatable about the pin 12, carried by the hook part 7, and its upper end 13 bears on the outer end of the keeper 14 of an electromagnet 15.

Figure 2:
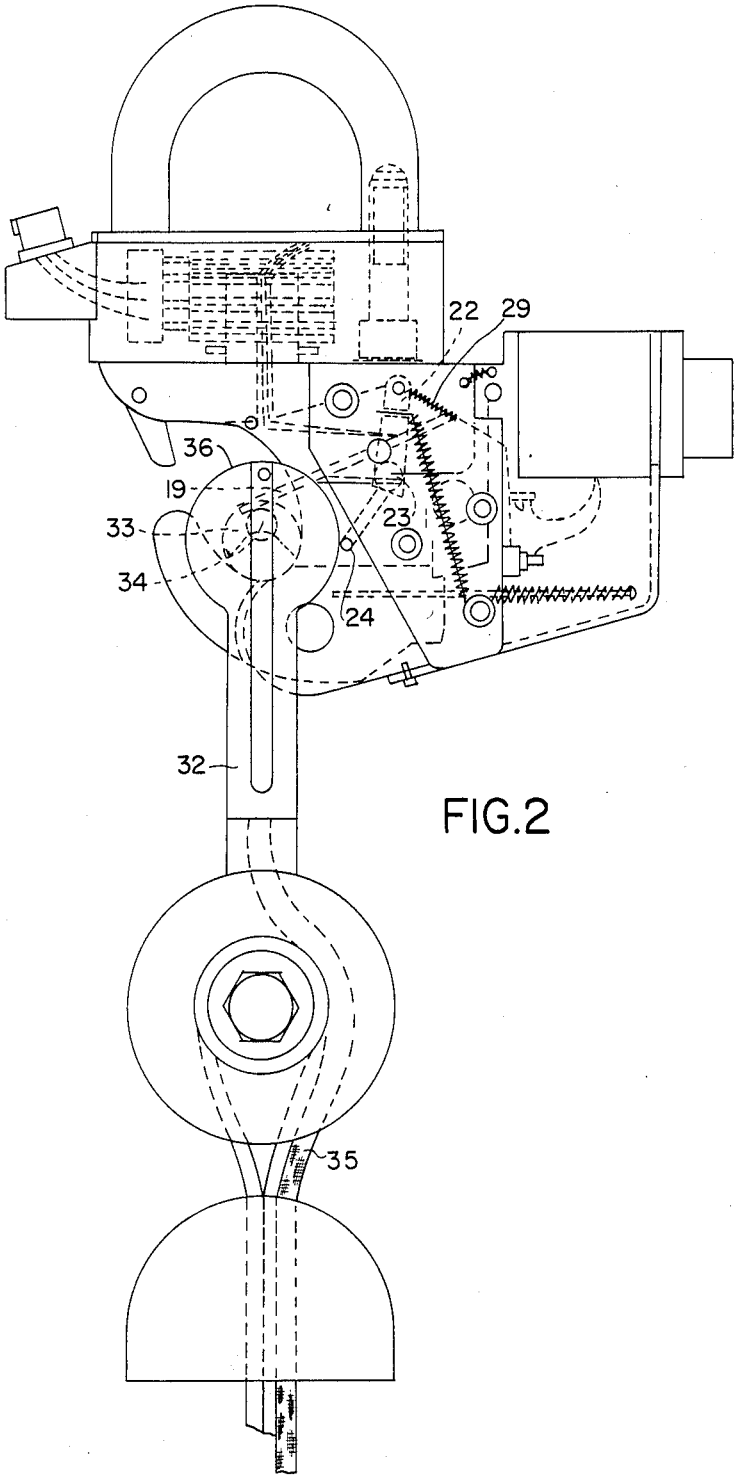
FIG. 2 is a similar view, with the lifting sling bracket hooked onto the suspension hook.
Figure 3:
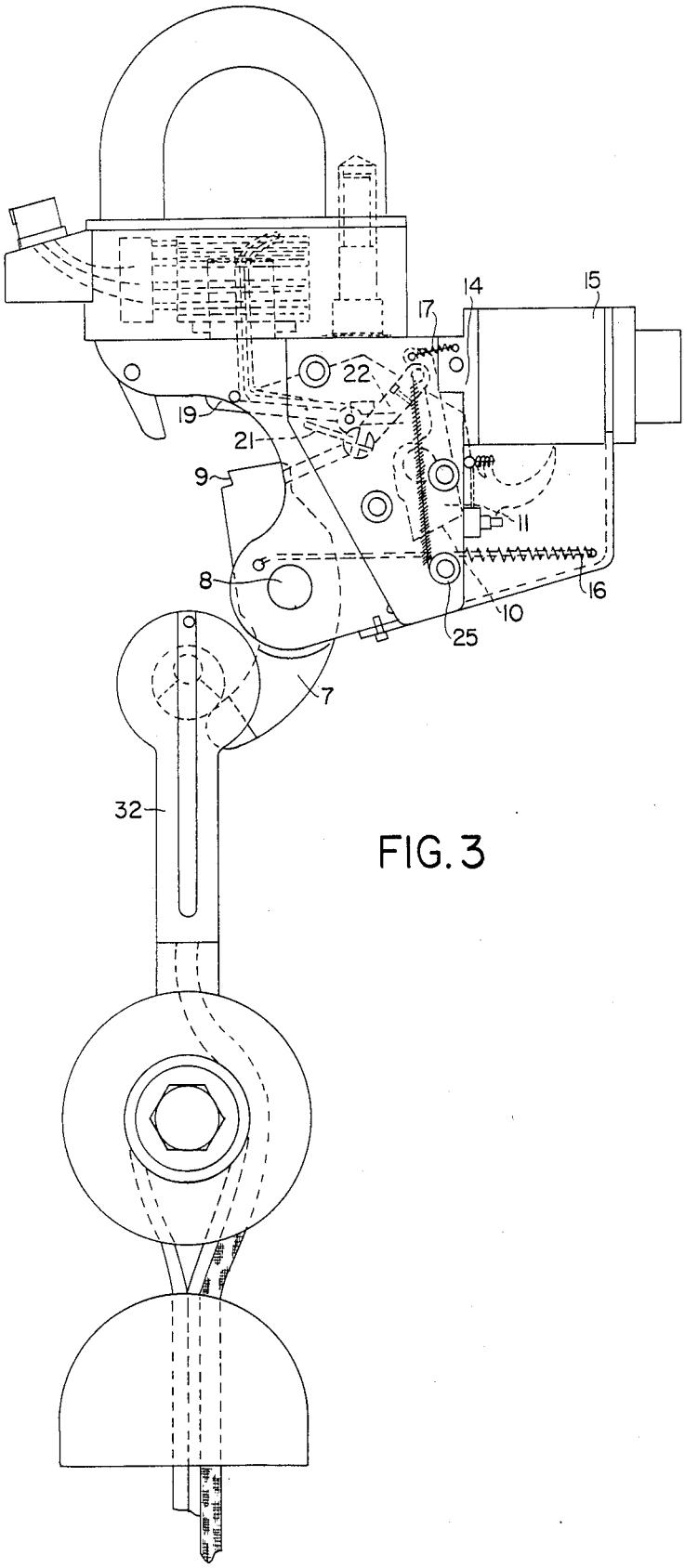
FIG. 3 is a view similar to that of FIG. 2, with the bracket unhooking from the suspension hook.

A spring 16, connected on one side to the hook part 1 and on the other side to the hook part 7, is positioned so as to return said hook part 1 to its lifted operating position, shown in FIGS. 1 and 2, wherein the tooth 9 is in engagement with the pawl end 10 of the lever 11.

A spring 17, connected between a fixed point on the body 1 and the upper end of the lever 11, returns this latter to its rest position, shown in FIG. 1, corresponding to the recessed position of the electromagnet keeper 14.

Two contact rods 19 are mounted oscillating about the pin 20 and are normally retained in the rest position, shown in FIG. 1, in which they are housed in a recessed seat formed in the lower surface of the base 3. To make the drawing more clear, the contact rods 19 are drawn in FIG. 1 external to said seat, but they disappear into said seat to be fully and efficiently protected, when they are in the rest position.

A rocking lever is rotatably mounted about the pin 23: a spring 25 is connected to a first arm 22 of said lever, causing it to rotate clockwise towards its rest position shown in FIG. 1. In this position, a second arm 21 of said rocking lever pushes the contact rod 19 towards its lifted rest position. With a third arm 24 of the rocking lever cooperates a bracket for a sling, in the manner better explained hereinafter.

Each contact rod 19 is formed as a two-armed lever: the first arm is the contact arm (the function of which is explained hereinafter), while at the rear end 27 of the second arm there is connected a spring 29. This latter is moreover connected at its other end to the first arm 22 of the rocking lever.

The four fixed contacts 5 are connected on one side to the tap 30 and on the other side, as already said, to the brushes which cooperate with the slip rings 4. From these latter depart four conductors, a first conductor being directly connected to the earth of the hook, a second conductor being connected to the electromagnet, while a third and a fourth conductor are connected to the contact rods 19. It is evident that, whenever required, the number of the connections can easily be changed by a technician in the field, with very simple modifications in respect of what is shown to be preferred in the drawings.

The hook unit is completed by a safety tooth 31 which, working in known manner, may oscillate only counterclockwise, starting from the position shown in FIG. 1.

A bracket 32, connected to the lifting sling, cooperates with the abovedescribed hook device. The bracket 32 ends at the top with a crosspiece 33 which finds a seat in the hook saddle 1,7. Two contact surfaces 34 are provided on said crosspiece 33, such surfaces being insulated one from the other and from the earth of the bracket. On said surfaces 34 bear—in the working conditions described hereinafter—the contact rods 19. From the earth of the bracket 32 and from the two surfaces 34 depart flexible conductors 35 which transmit (in known manner not forming part of the present invention), electric energy to the hanging container (not shown).

The operation of the heretofore described device is as follows: in the rest position shown in FIG. 1, the contact rods 19 are raised and housed in the seat formed in the base 3. In this position they are perfectly protected from atmospheric agents, as well as from accidental impacts which easily occur during hook shifting operations. In this same rest position, the hook part 7 is held in a raised position by the spring 16 and by engagement of its rear tooth 9 with the pawl end 10 of the lever 11.

Starting from this position, the bracket 32 is placed on the hook saddle 1,7 causing the oscillation of the safety tooth 31. When the crosspiece 33 of the bracket 32 rests in the hook saddle 1, 7, the bracket 32 shifts the arm 24 of the rocking lever 22, which oscillates counterclockwise, against the action of the return spring 25, up to the position shown in FIG. 2.

During said oscillation, the arm 21 of the lever 22 moves downward, so that the contact rods 19 may in turn oscillate counterclockwise to contact the contact surfaces 34 of the crosspiece 33. In this movement the rods 19 are driven by the spring 29, which is stretched by the counterclockwise movement of the lever 22. Said spring 29 then determines the pressure with which the rods 19 bear against the contact surfaces 34.

As can be easily observed, this arrangement allows obtaining, on one hand, the result that the contact rods 19 by no means interfere with the bracket 32, when this latter starts to introduce itself into the hook saddle 1,7; while on the other hand, as soon as said bracket moves towards its position of rest in the hook saddle, the contact rods 19 move down towards the crosspiece 33 and bear thereon with a predetermined pressure, so as to guarantee a perfect contact.

For the automatic release of the bracket 32, the electromagnet 15 is energized by means of an electric signal sent in known manner from the transport means, specifically from the helicopter, and fed through one of the contacts 5. Said magnet thus pushes outwards the keeper 14, thereby causing the counterclockwise oscillation of the lever 11. The pawl end 10 of the lever 11 disengages from the tooth 9 of the hook part 7; this latter is then free to rotate counterclockwise—simply under the weight of the bracket 32, which outweighs the action of the spring 16—thereby releasing said bracket 32.

It should be noted that, according to an interesting characteristic of the present invention, the tooth 9 is formed slightly undercut in respect of the pawl end 10 (as is evident from FIGS. 1 and 2). In this way, when all the load weighs on the bracket 32—which occurs when the container supported by the sling is still overhung—the pressure transmitted to the hook part 7 and, through this latter, to the tooth 9, is such that the pawl end 10 of the lever 11 is unable to disengage from the tooth 9, even though the electromagnet 15 is energized. This forms a safety against the untimely operation of the magnet before the load is rested on the ground.

It is anyhow understood that the invention is not limited to the particular embodiment described, but that it covers any modifications of the same, which may be introduced by a technician in the field, while remaining within the scope of the expressed inventive idea.

I claim:

1. In a device for supporting a bracket that supports a load lifting sling, said device being of the type comprising an eyelet having an enlarged base with a central hole, a pin rotatably supported in said hole and extending downward into a first hook part, a second hook part pivoted on the first about a pin with horizontal axis positioned in the lower end of the first hook part, releasable locking means to retain said second hook part in an active position to form with the first part an essentially closed hook, and electrical connection means to transmit electric signals from the hook to said bracket; the improvement in which said electrical connection means comprise at least one contact rod oscillating between a rest position, in which it is housed in a seat formed in said enlarged base, and an active position, in which it bears on a respective contact surface provided on a said bracket, a lever controlling said oxcillating movement, said lever moving under the action of said bracket being carried into the hooking position, and pressure spring means associated with said lever to control the pressure with which said contact rod bears on a said contact surface.

2. A device as in claim 1, wherein each contact rod is pivoted at a fixed point on the first hook part and wherein a rocking lever is provided, spring means acting on a first arm of said rocking lever to return the same to a rest position, a second arm of said lever cooperating with said contact rod to keep it in a rest position, under the return action of the latter said spring means.

3. A device as in claim 2, wherein said rocking lever comprises a third arm, with which cooperates said bracket while it is being hooked, in order to cause the oscillation of the rocking lever and consequently of each contact rod, toward an active position.

4. A device as in claim 1, wherein said spring means are interposed between an arm of a rocking lever and said contact rods, to press the latter into an active position of contact.

5. A device as in claim 4, wherein each contact rod is in the form of a two-armed lever, a first extended arm carrying the contact, while the other arm is connected to said spring means.

6. A device as in claim 1, wherein said means for locking the second hook part consist of a tooth carried by a tailpiece of said second hook part and of the pawl end of a locking lever, operated by an electromagnet, said tooth having an undercut profile for engagement with said pawl end.

* * * * *